US008307892B2

(12) United States Patent
Frazier

(10) Patent No.: US 8,307,892 B2
(45) **Date of Patent: *Nov. 13, 2012**

(54) CONFIGURABLE INSERTS FOR DOWNHOLE PLUGS

(76) Inventor: W. Lynn Frazier, Corpus Christi, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/357,570

(22) Filed: Jan. 24, 2012

(65) Prior Publication Data

US 2012/0118561 A1 May 17, 2012

Related U.S. Application Data

(63) Continuation of application No. 13/194,877, filed on Jul. 29, 2011, which is a continuation-in-part of application No. 12/799,231, filed on Apr. 21, 2010.

(60) Provisional application No. 61/214,347, filed on Apr. 21, 2009.

(51) Int. Cl.
*E21B 33/129* (2006.01)

(52) U.S. Cl. ..... 166/135; 166/181; 166/188

(58) Field of Classification Search ..... 166/118, 166/124, 135, 138, 181, 188, 193, 328, 329, 166/192, 194

See application file for complete search history.

(56) References Cited

U.S. PATENT DOCUMENTS

| | | | | |
|---|---|---|---|---|
| RE17,217 | E | 2/1929 | Burch | |
| 2,040,889 | A | 5/1933 | Whinnen | |
| 2,223,602 | A | 10/1938 | Cox | |
| 2,160,228 | A * | 5/1939 | Pustmueller | 166/264 |
| 2,286,126 | A | 7/1940 | Thornhill | |
| 2,376,605 | A | 5/1945 | Lawrence | |
| 2,593,520 | A | 10/1945 | Baker et al. | |
| 2,616,502 | A | 3/1948 | Lenz | |
| 2,756,827 | A | 6/1948 | Farrar | |
| 2,737,242 | A | 8/1952 | Baker | |
| 2,640,546 | A | 6/1953 | Baker et al. | |
| 2,833,354 | A | 2/1955 | Sailers | |
| 3,054,453 | A | 3/1955 | Bonner | |
| 2,713,910 | A | 7/1955 | Baker et al. | |
| 2,714,932 | A | 8/1955 | Thompson | |

(Continued)

FOREIGN PATENT DOCUMENTS

GB 914030 12/1962

(Continued)

OTHER PUBLICATIONS

"Halliburton Services, Sales & Service Catalog No. 43," Halliburton Co., 1985 (202 pages).

(Continued)

*Primary Examiner* — Kenneth L Thompson
*Assistant Examiner* — Robert E Fuller
(74) *Attorney, Agent, or Firm* — Edmonds & Nolte, P.C.

(57) ABSTRACT

A configurable insert for a downhole tool. The configurable insert can have a body having a bore formed therethrough, at least one shear groove disposed on the body, wherein the body separates at the shear groove when exposed to a predetermined force, applied by a threadably engaged component therewith, at least one shoulder disposed within the bore, the shoulder formed by a transition between a larger inner diameter and a smaller inner diameter of the bore, wherein the shoulder is adapted to receive one or more impediments at least partially within the bore, and one or more threads disposed on an outer surface of the body for connecting the body to a downhole tool.

28 Claims, 8 Drawing Sheets

U.S. PATENT DOCUMENTS 2,830,666 A 7/1956 Rhodes
3,062,296 A 12/1960 Brown
3,082,824 A 3/1963 Taylor et al.
3,013,612 A 12/1964 Angel
3,160,209 A 12/1964 Bonner
3,163,225 A 12/1964 Perkins
3,273,588 A 9/1966 Dollison
3,282,342 A 11/1966 Mott
3,291,218 A 12/1966 Lebourg
3,298,440 A 1/1967 Current
3,308,895 A 3/1967 Oxford et al.
3,356,140 A 12/1967 Young
3,393,743 A 7/1968 Stanescu
3,429,375 A 2/1969 Craig
3,517,742 A 6/1970 Williams
3,554,280 A 1/1971 Tucker
3,623,551 A 11/1971 Randermann, Jr.
3,687,202 A 8/1972 Young et al.
3,818,987 A 6/1974 Ellis
3,851,706 A 12/1974 Ellis
3,860,066 A 1/1975 Pearce et al.
3,926,253 A 12/1975 Duke
4,049,015 A 9/1977 Brown
4,134,455 A 1/1979 Read
4,151,875 A * 5/1979 Sullaway ..... 166/126
4,185,689 A 1/1980 Harris
4,314,608 A 2/1982 Richardson
4,391,547 A 7/1983 Jackson
4,405,017 A 9/1983 Allen et al.
4,432,418 A 2/1984 Mayland
4,436,151 A 3/1984 Callihan et al.
4,437,516 A 3/1984 Cockrell
4,457,376 A 7/1984 Carmody et al.
4,493,374 A 1/1985 Magee, Jr.
4,532,995 A 8/1985 Kaufman
4,554,981 A 11/1985 Davies
4,566,541 A 1/1986 Moussy et al.
4,585,067 A 4/1986 Blizzard et al.
4,595,052 A 6/1986 Kristiansen
4,602,654 A 7/1986 Stehling et al.
4,688,641 A 8/1987 Knieriemen
4,708,163 A 11/1987 Deaton
4,708,202 A 11/1987 Sukup et al.
4,776,410 A 10/1988 Perkin et al.
4,784,226 A 11/1988 Wyatt
4,792,000 A 12/1988 Perkin et al.
4,830,103 A 5/1989 Blackwell et al.
4,848,459 A 7/1989 Blackwell et al.
4,893,678 A 1/1990 Stokley et al.
5,020,590 A 6/1991 McLeod
5,095,980 A 3/1992 Watson
5,113,940 A 5/1992 Glaser
5,117,915 A 6/1992 Mueller et al.
5,154,228 A 10/1992 Gambertoglio et al.
5,183,068 A 2/1993 Prosser
5,188,182 A 2/1993 Echols, III et al.
5,207,274 A 5/1993 Streich et al.
5,209,310 A 5/1993 Clydesdale
5,224,540 A 7/1993 Streich et al.
5,230,390 A 7/1993 Zastresek et al.
5,234,052 A 8/1993 Coone et al.
5,253,705 A 10/1993 Clary et al.
5,311,939 A 5/1994 Pringle et al.
5,316,081 A 5/1994 Baski et al.
5,343,954 A 9/1994 Bohlen et al.
5,419,399 A 5/1995 Smith
5,564,502 A 10/1996 Crow et al.
5,593,292 A 1/1997 Ivey et al.
5,803,173 A 9/1998 Fraser, III et al.
5,810,083 A 9/1998 Kilgore
5,988,277 A * 11/1999 Vick et al. ..... 166/123
6,012,519 A 1/2000 Allen et al.
6,098,716 A 8/2000 Hromas et al.
6,142,226 A 11/2000 Vick
6,152,232 A 11/2000 Webb et al.
6,167,963 B1 1/2001 McMahan
6,182,752 B1 2/2001 Smith, Jr. et al.
6,199,636 B1 3/2001 Harrison
6,220,349 B1 * 4/2001 Vargus et al. ..... 166/138
6,283,148 B1 9/2001 Spears et al.
6,491,108 B1 12/2002 Slup et al.
6,629,563 B2 10/2003 Doane
6,695,049 B2 2/2004 Ostocke et al.
6,708,770 B2 3/2004 Slup et al.
6,725,935 B2 4/2004 Szarka et al.
6,739,398 B1 5/2004 Yokely et al.
6,769,491 B2 8/2004 Zimmerman et al.
6,796,376 B2 9/2004 Frazier
6,799,633 B2 10/2004 McGregor
6,834,717 B2 12/2004 Bland
6,851,489 B2 2/2005 Hinds
6,902,006 B2 6/2005 Myerley et al.
6,918,439 B2 7/2005 Dallas
6,938,696 B2 9/2005 Dallas
7,021,389 B2 4/2006 Bishop et al.
7,040,410 B2 5/2006 McGuire et al.
7,055,632 B2 6/2006 Dallas
7,069,997 B2 7/2006 Coyes et al.
7,107,875 B2 9/2006 Haugen et al.
7,128,091 B2 10/2006 Istre, Jr.
7,168,494 B2 1/2007 Starr et al.
7,281,584 B2 10/2007 McGarian et al.
7,325,617 B2 2/2008 Murray
7,337,847 B2 3/2008 McGarian et al.
7,350,582 B2 4/2008 McKeachnie et al.
7,353,879 B2 4/2008 Todd et al.
7,363,967 B2 4/2008 Burris, II et al.
7,373,973 B2 5/2008 Smith et al.
7,527,104 B2 5/2009 Branch et al.
7,552,779 B2 6/2009 Murray
7,604,058 B2 10/2009 McGuire
7,637,326 B2 12/2009 Bolding et al.
7,644,767 B2 1/2010 Kalb et al.
7,644,774 B2 1/2010 Branch et al.
7,673,677 B2 3/2010 King et al.
7,690,436 B2 4/2010 Turley et al.
7,740,079 B2 6/2010 Clayton et al.
7,775,286 B2 8/2010 Duphorne
7,775,291 B2 8/2010 Jacob
7,784,550 B2 8/2010 Nutley et al.
7,798,236 B2 9/2010 McKeachnie et al.
7,810,558 B2 10/2010 Shkurti et al.
7,866,396 B2 1/2011 Rytlewski
7,878,242 B2 2/2011 Gray
7,886,830 B2 2/2011 Bolding et al.
7,909,108 B2 3/2011 Swor et al.
7,909,109 B2 3/2011 Angman et al.
7,918,278 B2 4/2011 Barbee
7,921,923 B2 4/2011 McGuire
7,921,925 B2 4/2011 Maguire et al.
7,926,571 B2 4/2011 Hofman
8,074,718 B2 12/2011 Roberts
2003/0024706 A1 2/2003 Allamon
2003/0188860 A1 10/2003 Zimmerman et al.
2007/0051521 A1 3/2007 Fike et al.
2007/0107908 A1 5/2007 Vaidya et al.
2008/0110635 A1 5/2008 Loretz et al.
2009/0211749 A1 8/2009 Nguyen et al.
2010/0132960 A1 6/2010 Shkurti et al.
2010/0155050 A1 6/2010 Frazier
2010/0252252 A1 10/2010 Harris et al.
2010/0263876 A1 10/2010 Frazier
2010/0276159 A1 11/2010 Mailand et al.
2010/0288503 A1 11/2010 Cuiper et al.
2011/0036564 A1 2/2011 Williamson
2011/0061856 A1 3/2011 Kellner et al.
2011/0088915 A1 4/2011 Stanojcic et al.
2011/0103915 A1 5/2011 Tedeshi
2011/0240295 A1 10/2011 Porter et al.
2011/0259610 A1 10/2011 Shkurti et al.

FOREIGN PATENT DOCUMENTS

WO WO2010127457 11/2010

OTHER PUBLICATIONS

"Teledyne Merla Oil Tools-Products-Services," Teledyne Merla, Aug. 1990 (40 pages).

"78/79 Catalog: Packers-Plugs-Completions Tools," Pengo Industries, Inc., 1978-1979 (12 pages).
"MAP Oil Tools Inc. Catalog," Map Oil Tools, Apr. 1999 (46 pages).
"Lovejoy—where the world turns for couplings," Lovejoy, Inc., Dec. 2000 (30 pages).
"Halliburton Services, Sales & Service Catalog," Halliburton Services, 1970-1971 (2 pages).
"Alpha Oil Tools Catalog," Alpha Oil Tools, 1997 (136 pages).
"1975-1976 Packer Catalog," Gearhart-Owen Industries Inc., 1975-1976 (52 pages).
"Formation Damage Control Utilizing Composite-Bridge Plug Technology for Monobore, Multizone Stimulation Operations," Gary Garfield, SPE, May 15, 2001 (8 pages).
"Composite Bridge Plug Technique for Multizone Commingled Gas Wells," Gary Garfield, SPE, Mar. 24, 2001 (6 pages).
"Composite Research: Composite bridge plugs used in multi-zone wells to avoid costly kill-weight fluids," Gary Garfield, SPE, Mar. 24, 2001 (4 pages).
"It's About Time—Quick Drill Composite Bridge Plug," Baker Oil Tools, Jun. 2002 (2 pages).
"Baker Hughes—Baker Oil Tools—Workover Systems—Quik Drill Composite Bridge Plug," Baker Oil Tools, Dec. 2000 (3 pages).
"Baker Hughes 100 Years of Service," Baker Hughes in Depth, Special Centennial Issue, Publication COR-07-13127, vol. 13, No. 2, Baker Hughes Incorporated, Jul. 2007 (92 pages).

* cited by examiner

CONFIGURABLE INSERTS FOR DOWNHOLE PLUGS

CROSS-REFERENCE TO RELATED APPLICATIONS

This application is a continuation of U.S. patent application having Ser. No. 13/194,877, filed on Jul. 29, 2011, which is a continuation-in-part of U.S. patent application having Ser. No. 12/799,231, filed Apr. 21, 2010, which claims priority to U.S. Provisional Patent Application having Ser. No. 61/214,347, filed Apr. 21, 2009, the entirety of each being incorporated by reference herein.

BACKGROUND

1. Field

Embodiments described generally relate to downhole tools. More particularly, embodiments described relate to configurable inserts that can be engaged in downhole plugs for controlling fluid flow through one or more zones of a wellbore.

2. Description of the Related Art

Bridge plugs, packers, and frac plugs are downhole tools that are typically used to permanently or temporarily isolate one wellbore zone from another. Such isolation is often necessary to pressure test, perforate, frac, or stimulate a zone of the wellbore without impacting or communicating with other zones within the wellbore. To reopen and/or restore fluid communication through the wellbore, plugs are typically removed or otherwise compromised.

Permanent, non-retrievable plugs and/or packers are typically drilled or milled to remove. Most non-retrievable plugs are constructed of a brittle material such as cast iron, cast aluminum, ceramics, or engineered composite materials, which can be drilled or milled. Problems sometimes occur, however, during the removal or drilling of such non-retrievable plugs. For instance, the non-retrievable plug components can bind upon the drill bit, and rotate within the casing string. Such binding can result in extremely long drill-out times, excessive casing wear, or both. Long drill-out times are highly undesirable, as rig time is typically charged by the hour.

In use, non-retrievable plugs are designed to perform a particular function. A bridge plug, for example, is typically used to seal a wellbore such that fluid is prevented from flowing from one side of the bridge plug to the other. On the other hand, drop ball plugs allow for the temporary cessation of fluid flow in one direction, typically in the downhole direction, while allowing fluid flow in the other direction. Depending on user preference, one plug type may be advantageous over another, depending on the completion and/or production activity.

Certain completion and/or production activities may require several plugs run in series or several different plug types run in series. For example, one well may require three bridge plugs and five drop ball plugs, and another well may require two bridge plugs and ten drop ball plugs for similar completion and/or production activities. Within a given completion and/or for a given production activity, the well may require several hundred plugs and/or packers depending on the productivity, depths, and geophysics of each well. The uncertainty in the types and numbers of plugs that might be required typically leads to the over-purchase and/or under-purchase of the appropriate types and numbers of plugs resulting in fiscal inefficiencies and/or field delays.

There is a need, therefore, for a downhole tool that can effectively seal the wellbore at wellbore conditions; be quickly, easily, and/or reliably removed from the wellbore; and configured in the field to perform one or more functions.

BRIEF DESCRIPTION OF THE DRAWINGS

Non-limiting, illustrative embodiments are depicted in the drawings, which are briefly described below. It is to be noted, however, that these illustrative drawings illustrate only typical embodiments and are not to be considered limiting of its scope, for the invention can admit to other equally effective embodiments.

DETAILED DESCRIPTION

A configurable insert for use in a downhole plug is provided. The configurable insert can be adapted to receive or engage one or more impediments that control fluid flow in one or more directions therethrough. The configurable insert is designed to shear when a predetermined axial, radial, or a combined axial and radial force is applied, allowing a setting tool to be released from the configurable insert. The term "shear" means to fracture, break, or otherwise deform thereby releasing two or more engaged components, parts, or things, thereby partially or fully separating a single component into two or more components and/or pieces.

The term "plug" refers to any tool used to permanently or temporarily isolate one wellbore zone from another, including any tool with blind passages, plugged mandrels, as well as open passages extending completely therethrough and passages that are blocked with a check valve. Such tools are commonly referred to in the art as "bridge plugs," "frac plugs," and/or "packers." And such tools can be a single assembly (i.e., one plug) or two or more assemblies (i.e., two or more plugs) disposed within a work string or otherwise connected thereto that is run into a wellbore on a wireline, slickline, production tubing, coiled tubing or any technique known or yet to be discovered in the art.

Figure 1:
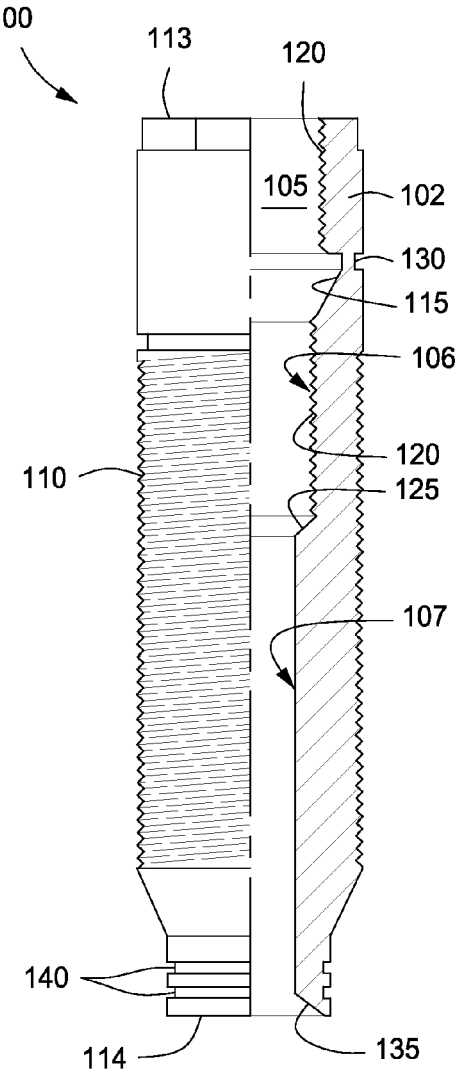
FIG. 1 depicts an illustrative, partial section view of a configurable insert for use with a plug, according to one or more embodiments described.

FIG. 1 depicts an illustrative, partial section view of a configurable insert 100 for use with a downhole plug, according to one or more embodiments. The configurable insert 100 can include a body 102 having a passageway or bore 105 formed completely or at least partially therethrough. The body 102 can have one or more threads 110 cut into, formed on, or otherwise positioned on an outer surface thereof and one or more threads 120 disposed about, cut into, or formed or otherwise positioned on an inner surface thereof.

The configurable insert 100 can further include one or more shear grooves 130 adapted to shear at a predetermined force or stress. The term "shear groove," is intended to refer to any component, part, element, member, or thing that shears or is capable of shearing at a predetermined force that is less than the force required to shear the body of the plug. For example, the shear groove 130 can be a channel and/or indentation disposed on or formed into the inner and/or outer surface of the configurable insert 100 so that the insert 100 has a reduced wall thickness at the point of the shear groove 130. The shear groove 130 can be continuous about the inner or outer surface of the configurable insert 100 or the shear groove 130 can be intermittently formed thereabout using any pattern or frequency of channels and/or indentations. The shear groove 130 is intended to separate or break when exposed to a given or predetermined force. As will be explained in more detail below, the configurable insert 100 is designed to break at any of the one or more shear grooves 130 disposed thereon when a predetermined axial, radial, or combination of axial and radial forces is applied to the configurable insert 100.

The bore 105 can have a constant diameter throughout, or the diameter can vary, as depicted in FIG. 1. For example, the bore 105 can include one or more larger diameter portions or areas 106 that transition to one or more smaller diameter portions or areas 107, forming at least one seat or shoulder 125 therebetween. The shoulder 125 can be a sloped surface between the two portions or areas 106, 107, as depicted in FIG. 1. Similarly, a second shoulder 115 can be formed as a result of a transition to the larger diameter portion or area 106 from the shear groove 130 having a reduced wall thickness such that the shear groove 130 can define a diameter larger than the diameter of the larger diameter portion or area 106. Further, a third shoulder 135 can be formed by the transition from the portion or area 107 to the lower end 114 of the body 102. The seats or shoulders 115, 125, 135 can be sloped surfaces, as depicted in FIG. 1, or alternatively flat or substantially flat (not shown).

The threads 110 can facilitate connection of the configurable insert 100 to a plug, as described below in more detail. Any number of threads 110 can be used. The number of threads 110, for example, can range from about 2 to about 100, such as about 2 to about 50; about 3 to about 25; or about 4 to about 10. The number of threads 110 can also range from a low of about 2, 4, or 6 to a high of about 7, 12, or 20. The pitch of the threads 110 can range from about 0.1 mm to about 200 mm; 0.2 mm to about 150 mm; 0.3 mm to about 100 mm; or about 0.1 mm to about 50 mm. The pitch of the threads 110 can also range from a low of about 0.1 mm, 0.2 mm, or 0.3 mm to a high of about 2 mm, 5 mm or 10 mm. The pitch of the threads 110 can also vary along the axial length of the body 102, for example, ranging from about 0.1 mm to about 200 mm; 0.2 mm to about 150 mm; 0.3 mm to about 100 mm; or about 0.1 mm to about 50 mm. The pitch of the threads 110 can also vary along the axial length of the body 102 from a low of about 0.1 mm, 0.2 mm, or 0.3 mm to a high of about 2 mm, 5 mm or 10 mm.

The threads 120 are disposed on an inner surface the body 102 for threadably attaching the configurable insert 100 to another configurable insert 100, a setting tool, another downhole tool, plug, or tubing string. The threads 120 can be located toward, near, or at the upper end 113. Any number of threads 120 can be used. The number of threads 110, for example, can range from about 2 to about 100, such as about 2 to about 50; about 3 to about 25; or about 4 to about 10. The number of threads 120 can also range from a low of about 2, 4, or 6 to a high of about 7, 12, or 20. The pitch of the threads 120 can range from about 0.1 mm to about 200 mm; 0.2 mm to about 150 mm; 0.3 mm to about 100 mm; or about 0.1 mm to about 50 mm. The pitch of the threads 120 can also range from a low of about 0.1 mm, 0.2 mm, or 0.3 mm to a high of about 2 mm, 5 mm or 10 mm. The pitch of the threads 120 can also vary along the axial length of the body 102, for example, ranging from about 0.1 mm to about 200 mm; 0.2 mm to about 150 mm; 0.3 mm to about 100 mm; or about 0.1 mm to about 50 mm. The pitch of the threads 120 can also vary along the axial length of the body 102 from a low of about 0.1 mm, 0.2 mm, or 0.3 mm to a high of about 2 mm, 5 mm or 10 mm.

The first or upper end 113 of the configurable insert 100 can be shaped to engage one or more tools to locate and tighten the configurable insert 100 onto the plug. The end 113 can be, without limitation, hexagonal, slotted, notched, cross-head, square, torx, security torx, tri-wing, torq-set, spanner head, triple square, polydrive, one-way, spline drive, double hex, Bristol, Pentalobular, or other known component surface shape capable of being engaged.

The second or lower end 114 of the configurable insert 100 can include one or more grooves or channels 140 disposed or otherwise formed on an outer surface thereof. A sealing material, such as an elastomeric O-ring, can be disposed within the one or more channels 140 to provide a fluid seal between the configurable insert 100 and the plug when installed therein. Although a portion of the outer surface or outer diameter of the body 102 proximal the lower end 114 of the configurable insert 100 is depicted as being tapered, the outer surface or diameter of the lower end 114 can have a constant outer diameter.

As will be explained in more detail below, any of the shoulders 115, 125, 135 can serve as a seat for an impediment to block or restrict flow in one or both directions through the bore 105. The term "impediment" means any plug, ball, flapper, stopper, combination thereof, or thing known in the art capable of blocking fluid flow, in one or both axial directions, through the configurable insert 100 and creating a tight fluid seal at one or more of the shoulder 115, 125, 135. The impediment may or may not be threadably attached to one or more interior threads 120 of the configurable insert 100 and may be coupled to the body 102 in another suitable manner.

Figure 2:
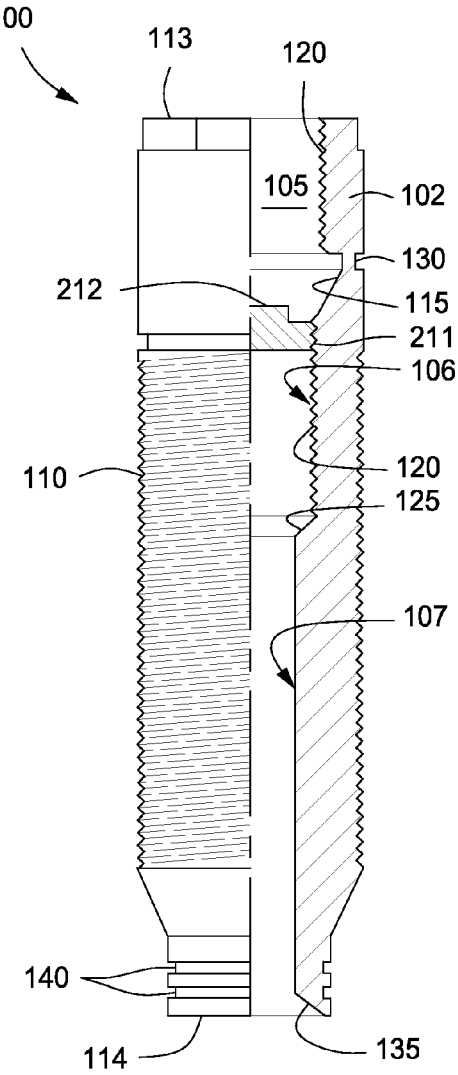
FIG. 2 depicts an illustrative, partial section view of a configurable insert configured with a solid impediment to block fluid flow bi-directionally, according to one or more embodiments described.

FIG. 2 depicts an illustrative, partial section view of the configurable insert 100, adapted to engage a solid impediment 211 to block fluid flow in two directions, according to one or more embodiments. The solid impediment 211 can be a cork, cap, bung, cover, top, lid, plate, or any component capable of preventing fluid flow fluid flow in all directions through the bore 105. The solid impediment 211 can be capable of being secured to the interior surface of the bore 105, via the threads 120; however, alternatively, the impediment 211 can be retained within the bore 105 by a pin or shaft, or otherwise welded or adhered in place.

Figure 3:
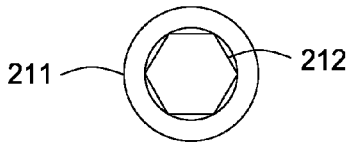
FIG. 3 depicts a top plan view of an illustrative, solid impediment that can be engaged in the configurable insert, according to one or more embodiments described.

FIG. 3 depicts a top plan view of the illustrative solid impediment 211, according to one or more embodiments. The solid impediment 211 can include a head or other interface 212 for engaging one or more tools to locate and tighten the solid impediment 211 onto or into the configurable insert 100. The interface 212 can be, without limitation, hexagonal, slotted, notched, cross-head, square, torx, security torx, tri-wing, torq-set, spanner head, triple square, polydrive, one-way, spline drive, double hex, Bristol, Pentalobular, or other known component surface shape capable of being engaged.

Figure 4:
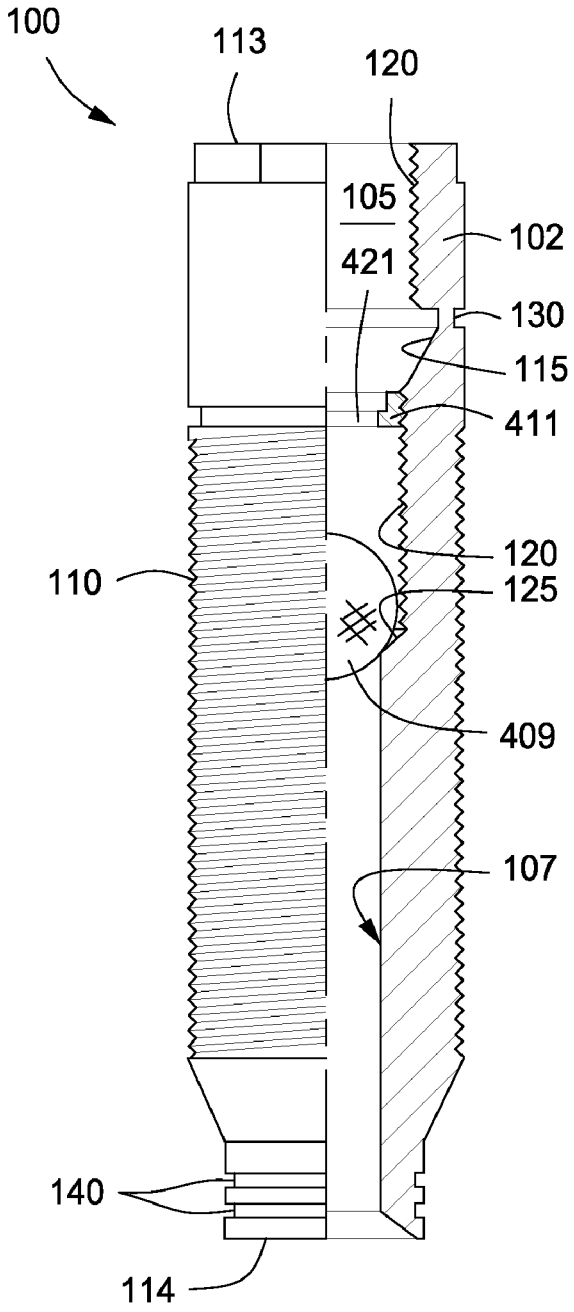
FIG. 4 depicts an illustrative, partial section view of a configurable insert configured to block fluid flow in at least one direction, according to one or more embodiments described.

FIG. 4 depicts an illustrative, partial section view of the configurable insert 100 adapted to block fluid flow in one direction but allow fluid flow in the other direction, according to one or more embodiments. The configurable insert 100 can be adapted to receive an impediment provided by a ball stop 411 and a ball 409 received in the bore 105, as shown. The ball stop 411 can be coupled in the bore 105 via the threads 120, such that the ball stop 411 can be easily inserted in the field, for example. Further, the ball stop 411 can be configured to retain the ball 409 in the bore 105 between the ball stop 411 and the shoulder 125. The ball 409 can be shaped and sized to provide a fluid tight seal against the seat or shoulder 125 to restrict fluid movement through the bore 105 in the configurable insert 100. However, the ball 409 need not be entirely spherical, and can be provided as any size and shape suitable to seal against the seat or shoulder 125.

Accordingly, the ball stop 411 and the ball 409 provide a one-way check valve. As such, fluid can generally flow from the lower end 114 of the configurable insert 100 to and out through the upper end 113 thereof; however, the bore 105 may be sealed from fluid flowing from the upper end 113 of the configurable insert 100 to the lower end 114. The ball stop 411 can be, for example, a plate, an annular cover, a ring, a bar, a cage, a pin, or other component capable of preventing the ball 409 from moving past the ball stop 411 in the direction towards the upper end 113 of the configurable insert 100, while still allowing fluid movement in the direction toward the upper end 113 of the configurable insert 100.

Figure 5:
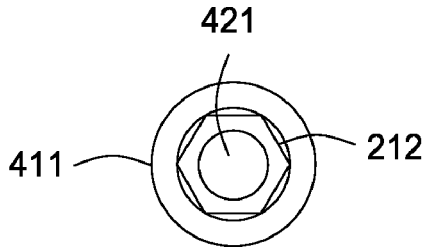
FIG. 5 depicts a top view of a ball stop for use in configurable insert, according to one or more embodiments described.

The ball stop 411 can be similar to the solid impediment 211, discussed and described above with reference to FIG. 2; however, the ball stop 411 has at least one aperture or hole 421 formed therethrough to allow fluid flow through the ball stop 411. The ball stop 411 can include the tool interface 212 for locating and fastening the ball stop 411 within the configurable insert 100. FIG. 5 depicts a top plan view of the illustrative ball stop 411, depicted in FIG. 4, according to one or more embodiments.

The configurable insert 100 can be formed or made from any metal, metal alloy, and/or combinations thereof, such that the configurable insert 100 can shear, break and/or otherwise deform sufficiently to separate along the shear groove 130 at a predetermined axial, radial, or combination axial and radial force without the configurable insert 100, the connection between the configurable insert 100 and the plug, or the plug being damaged. Preferably, at least a portion of the configurable insert 100 is made of an alloy that includes brass. Suitable brass compositions include, but are not limited to, admiralty brass, Aich's alloy, alpha brass, alpha-beta brass, aluminum brass, arsenical brass, beta brass, cartridge brass, common brass, dezincification resistant brass, gilding metal, high brass, leaded brass, lead-free brass, low brass, manganese brass, Muntz metal, nickel brass, naval brass, Nordic gold, red brass, rich low brass, tonval brass, white brass, yellow brass, and/or combinations thereof.

The configurable insert 100 can also be formed or made from other metallic materials (such as aluminum, steel, stainless steel, copper, nickel, cast iron, galvanized or non-galvanized metals, etc.), fiberglass, wood, composite materials (such as ceramics, wood/polymer blends, cloth/polymer blends, etc.), and plastics (such as polyethylene, polypropylene, polystyrene, polyurethane, polyethylethylketone (PEEK), polytetrafluoroethylene (PTFE), polyamide resins (such as nylon 6 (N6), nylon 66 (N66)), polyester resins (such as polybutylene terephthalate (PBT), polyethylene terephthalate (PET), polyethylene isophthalate (PEI), PET/PEI copolymer) polynitrile resins (such as polyacrylonitrile (PAN), polymethacrylonitrile, acrylonitrile-styrene copolymers (AS), methacrylonitrile-styrene copolymers, methacrylonitrile-styrene-butadiene copolymers; and acrylonitrile-butadiene-styrene (ABS)), polymethacrylate resins (such as polymethyl methacrylate and polyethylacrylate), cellulose resins (such as cellulose acetate and cellulose acetate butyrate); polyimide resins (such as aromatic polyimides), polycarbonates (PC), elastomers (such as ethylene-propylene rubber (EPR), ethylene propylene-diene monomer rubber (EPDM), styrenic block copolymers (SBC), polyisobutylene (PIB), butyl rubber, neoprene rubber, halobutyl rubber and the like)), as well as mixtures, blends, and copolymers of any and all of the foregoing materials.

Figure 6:
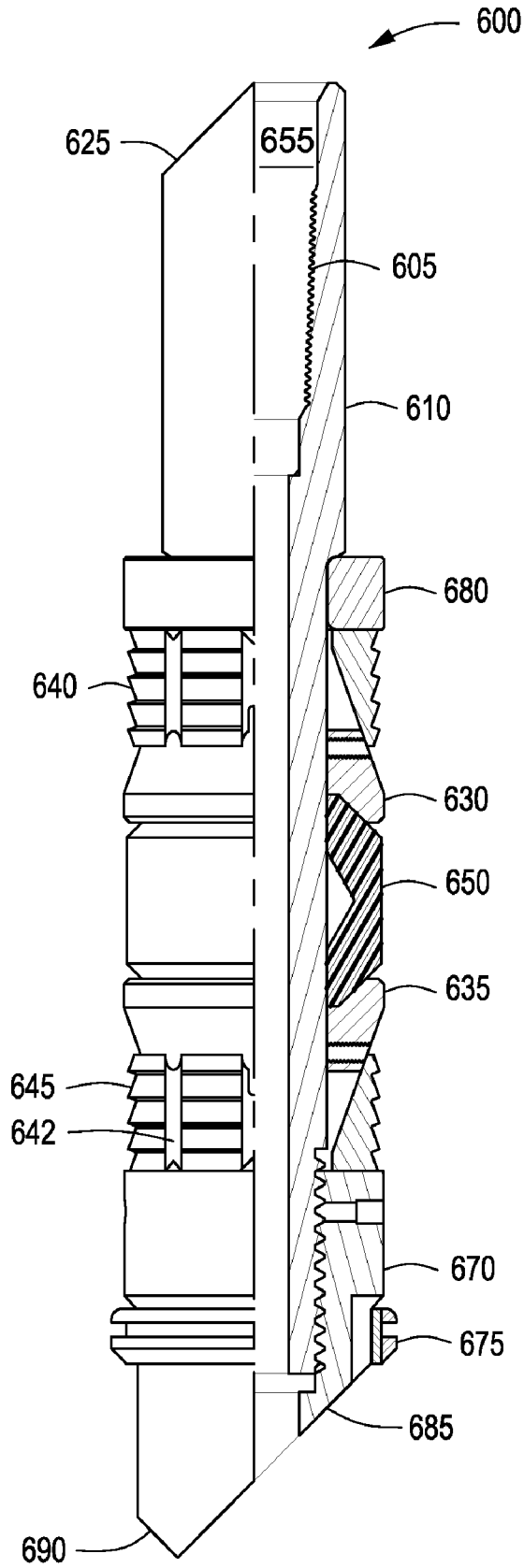
FIG. 6 depicts a partial section view of an illustrative plug suitable including a configurable insert, according to one or more embodiments described.
Figure 7A:
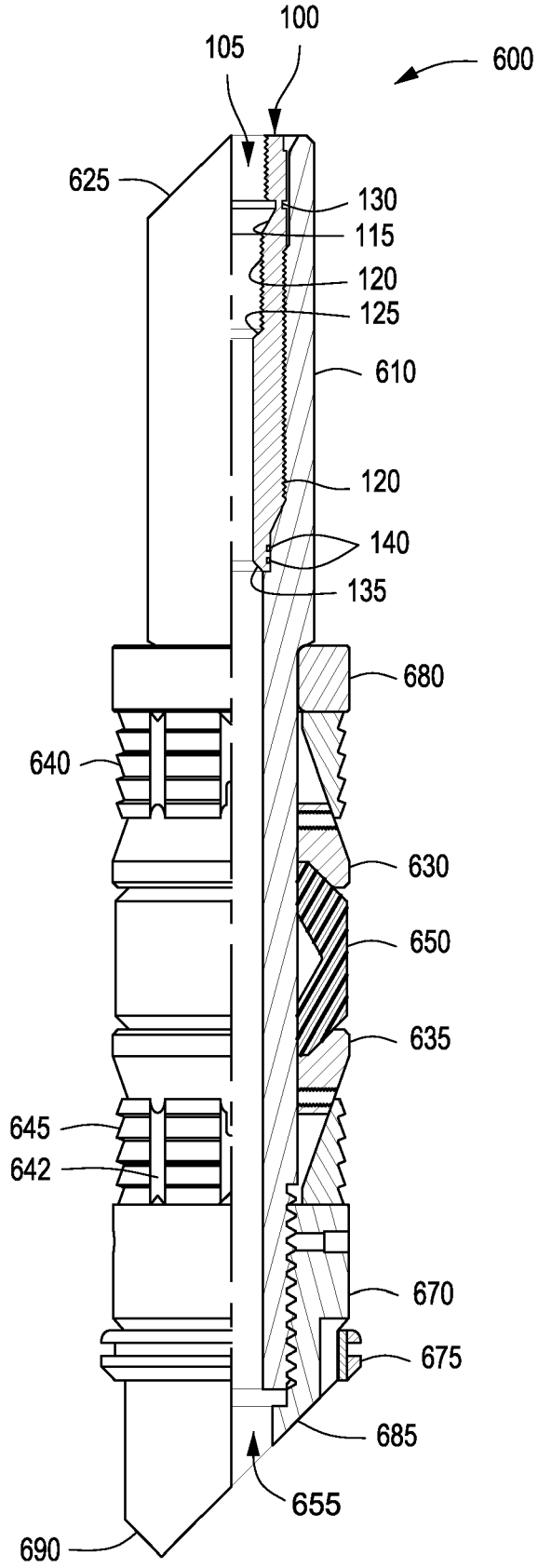
FIG. 7A depicts a partial section view of an illustrative plug including a configurable insert, according to one or more embodiments described.

FIG. 6 depicts an illustrative, partial section view of a plug 600 configured to receive the configurable insert 100, according to one or more embodiments. FIG. 7A depicts an illustrative, partial section view of the configurable insert 100 disposed within the plug 600, according to one or more embodiments. As depicted in FIG. 6, the plug 600 includes one or more threads 605 disposed at or near the end thereof where the configurable insert 100 can be threadably disposed or otherwise located within the bore 655 of the plug 600.

At least one conical member (two are shown: 630, 635), at least one slip (two are shown: 640, 645), and at least one malleable element 650 can be disposed about the mandrel 610. As used herein, the term "disposed about" means surrounding the component, e.g., the body 610, allowing for relative motion therebetween. A first section or second end of the conical members 630, 635 has a sloped surface adapted to rest underneath a complementary sloped inner surface of the slips 640, 645. As explained in more detail below, the slips 640, 645 travel about the surface of the adjacent conical members 630, 635, thereby expanding radially outward from the mandrel 610 to engage an inner surface of a surrounding tubular or borehole. A second section or second end of the conical members 630, 635 can include two or more tapered pedals or wedges adapted to rest about the malleable element 650. The wedges pivot, rotate or otherwise extend radially outward to contact an inner diameter of the surrounding tubular or borehole. Additional details of the conical members 630, 635 are described in U.S. Pat. No. 7,762,323, the entirety of which is incorporated herein by reference to the extent consistent with the present disclosure.

The inner surface of each slip 640, 645 can conform to the first end of the adjacent conical member 630, 635. An outer surface of the slips 640, 645 can include at least one outwardly-extending serration or edged tooth to engage an inner surface of a surrounding tubular, as the slips 640, 645 move radially outward from the mandrel 610 due to the axial movement across the adjacent conical members 630, 635.

The slips 640, 645 can be designed to fracture with radial stress. The slips 640, 645 can include at least one recessed groove 642 milled therein to fracture under stress allowing the slips 640, 645 to expand outward and engage an inner surface of the surrounding tubular or borehole. For example, the slips 640, 645 can include two or more, for example, preferably four, sloped segments separated by equally spaced recessed grooves 642 to contact the surrounding tubular or borehole.

The malleable element 650 can be disposed between the two or more conical members 630, 635. A single malleable element 650 is depicted in FIG. 6, but any number of elements 650 can be used as part of a malleable element system, as is well-known in the art. The malleable element 650 can be constructed of any one or more malleable materials capable of expanding and sealing an annulus within the wellbore. The malleable element 650 is preferably constructed of one or more synthetic materials capable of withstanding high temperatures and pressures, including temperatures up to 450° F., and pressure differentials up to 15,000 psi. Illustrative materials include elastomers, rubbers, TEFLON®, blends and combinations thereof.

The malleable element(s) 650 can have any number of configurations to effectively seal the annulus. For example, the malleable element(s) 650 can include one or more grooves, ridges, indentations, or protrusions designed to allow the malleable element(s) 650 to conform to variations in the shape of the interior of the surrounding tubular or borehole.

At least one component, ring or other annular member 680 for receiving an axial load from a setting tool can be disposed about the mandrel 610 and adjacent a first end of the slip 640. The annular member 680 can have first and second ends that are substantially flat. The first end can serve as a shoulder adapted to abut a setting tool (not shown). The second end can abut the slip 640 and transmit axial forces therethrough.

Each end of the plug 600 can be the same or different. Each end of the plug 600 can include one or more anti-rotation features 670, disposed thereon. Each anti-rotation feature 670 can be screwed onto, formed thereon, or otherwise connected to or positioned about the mandrel 610 so that there is no relative motion between the anti-rotation feature 670 and the mandrel 610. Alternatively, each anti-rotation feature 670 can be screwed onto or otherwise connected to or positioned about a shoe, nose, cap or other separate component, which can be made of composite, that is screwed onto threads, or otherwise connected to or positioned about the mandrel 610 so that there is no relative motion between the anti-rotation feature 670 and the mandrel 610. The anti-rotation feature 670 can have various shapes and fauns. For example, the anti-rotation feature 670 can be or can resemble a mule shoe shape (not shown), half-mule shoe shape (illustrated in FIG. 10), flat protrusions or flats (illustrated in FIGS. 12 and 13), clutches (illustrated in FIG. 11), or otherwise angled surfaces 625, 685, 690 (illustrated in FIGS. 6, 7A, 7B, and 8).

As explained in more detail below, the anti-rotation features 670 are intended to engage, connect, or otherwise contact an adjacent plug, whether above or below the adjacent plug, to prevent or otherwise retard rotation therebetween, facilitating faster drill-out or mill times. For example, the angled surfaces 685, 690 at the bottom of a first plug 200 can engage the sloped surface 625 at the top of a second plug 600 in series, so that relative rotation therebetween is prevented or greatly reduced.

A pump down collar 675 can be located about a lower end of the plug 600 to facilitate delivery of the plug 600 into the wellbore. The pump down collar 675 can be a rubber O-ring or similar sealing member to create an impediment in the wellbore during installation, so that a push surface or resistance can be created.

Figure 7B:
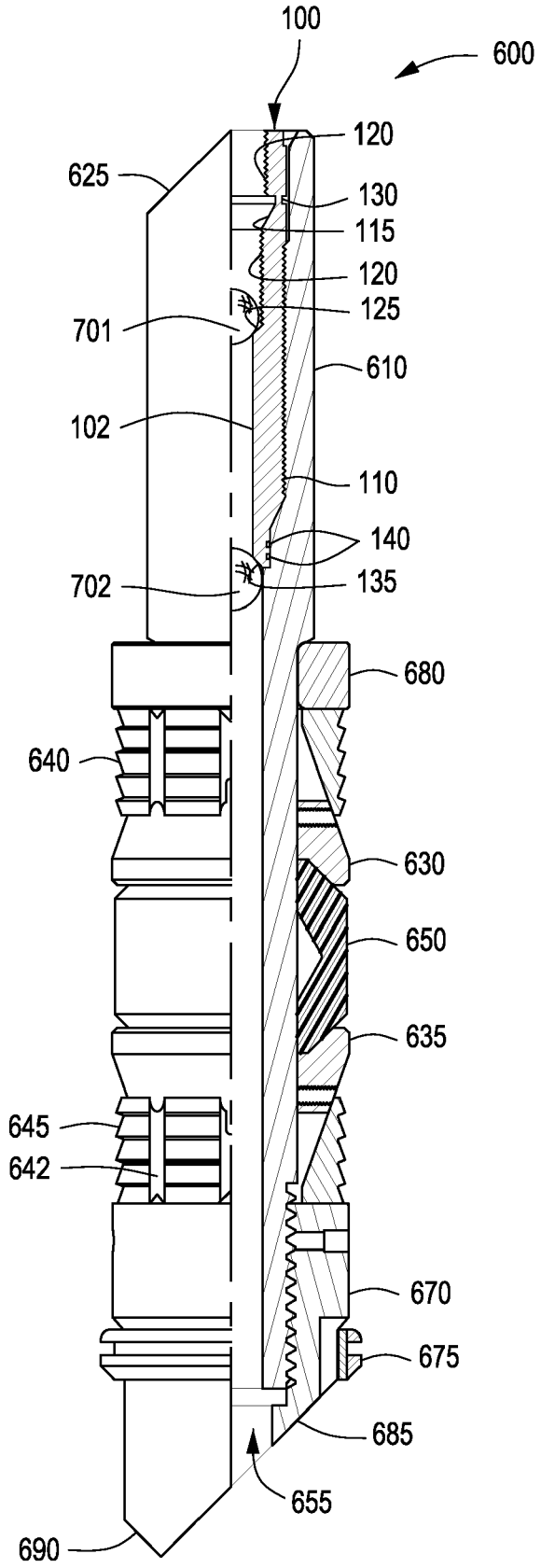
FIG. 7B depicts a partial section view of another illustrative plug including a configurable insert, according to one or more embodiments described.

FIGS. 7A and 7B depict illustrative, partial section views of the plug 600 with the configurable insert 100 disposed therein, according to one or more embodiments described. The configurable insert 100 can be configured to receive a drop ball 701, providing a flow impediment to control flow therein. As such, the solid impediment 212 and the ball stop 411 can be omitted. The drop ball 701 can be received in the configurable insert 100, for example, after deployment of the plug 600 in the wellbore, to constrain, restrict, and/or otherwise prevent fluid movement in the direction from the upper end 113 to the lower end 114 of the configurable insert 100. The drop ball 701 can rest on one of the shoulders 115 and/or 125 to form an essentially fluid tight seal therebetween.

The shoulder 115, 125 on which the drop ball 701 lands can depend on the relative sizing of the shoulder 115, 125 and the drop ball 701. For example, the lower shoulder 125 can provide a smaller-radius opening than does the upper shoulder 115. Accordingly, a smaller drop ball 701 may pass by the upper shoulder 115 and land on the lower shoulder 125. On the other hand, a larger drop ball 701 can land on the upper shoulder 115 and thus be constrained from reaching the lower shoulder 125. Further, multiple drop balls 701 can be employed and can be sized to be received on either shoulder 115, 125, or other shoulders that can be added to the configurable insert 100. In general, multiple drop balls 701 are deployed in increasing size, thereby providing for each shoulder 115, 125 (and/or others) to receive a drop ball 701 without the upper shoulders preventing access to the lower shoulders.

As depicted in FIG. 7B, the impediment can also include a ball 702, disposed in the bore 655 below the configurable insert 100. The ball 702 can be inserted into the bore 655 prior to the installation of the configurable insert 100, and can rest or seat against the shoulder 135 when fluid pressure is applied from the lower end of the plug 600. A retaining pin or a washer can be installed into the plug 600 prior to the ball 702 to prevent the ball 702 from escaping the bore 655. Accordingly, once deployed, the configurable insert can provide one or more shoulders 115, 125 to receive a drop ball 701 and can provide a shoulder 135 to seal with a ball 702 disposed in the bore 655 below the configurable insert 100. As such, fluid flow in both axial directions can be prevented: downward, by the drop ball 701 and upward, by the ball 702.

The plug 600 can be installed in a vertical, horizontal, or deviated wellbore using any suitable setting tool (not shown) adapted to engage the plug 600. One example of such a suitable setting tool or assembly includes a gas operated outer cylinder powered by combustion products and an adapter rod. The outer cylinder of the setting tool abuts an outer, upper end of the plug 600, such as against the annular member 680. The outer cylinder can also abut directly against the upper slip 640, for example, in embodiments of the plug 600 where the annular member 680 is omitted, or where the outer cylinder fits over or otherwise avoids bearing on the annular member 680. The adapter rod (not shown) is threadably connected to the mandrel 610 and/or the insert 100. Suitable setting assemblies that are commercially-available include the Owen Oil Tools wireline pressure setting assembly or a Model 10, 20 E-4, or E-5 Setting Tool available from Baker Oil Tools, for example.

Figure 8:
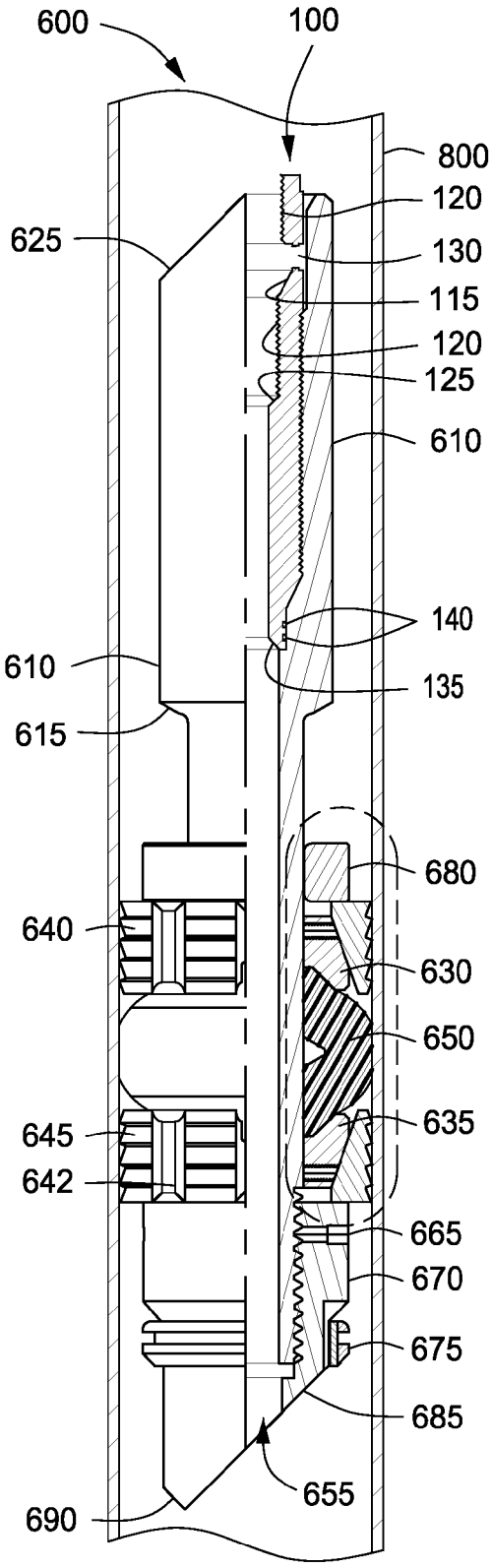
FIG. 8 depicts a partial section view of the plug of FIG. 7B after actuation within a wellbore, according to one or more embodiments described.
Figure 9:
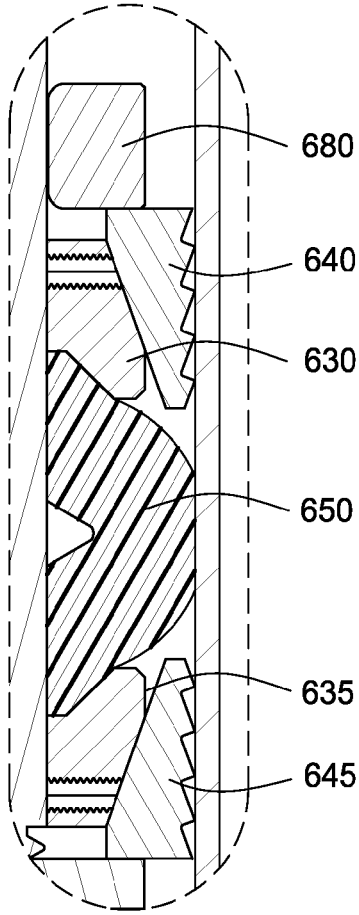
FIG. 9 depicts an enlarged, partial section view of the element system of the expanded plug depicted in FIG. 8, according to one or more embodiments described.

During the setting process, the outer cylinder (not shown) of the setting tool exerts an axial force against the outer, upper end of the plug 600 in a downward direction that is matched by the adapter rod (not shown) of the setting tool exerting an equal and opposite force from the lower end of the plug 600 in an upward direction. For example, in the embodiment illustrated in FIGS. 8 and 9, the outer cylinder of the setting assembly (not shown) exerts an axial force on the annular member 680, which translates the force to the slips 640, 645 and the malleable element 650 that are disposed about the mandrel 610 of the plug 600. The translated force fractures the recessed groove(s) 642 of the slips 640, 645, allowing the slips 640, 645 to expand outward and engage the inner surface of the casing or wellbore 800, while at the same time compresses the malleable element 650 to create a seal between the plug 600 and the inner surface of the casing or wellbore 800, as shown in FIG. 8. FIG. 8 depicts an illustrative partial section view of the expanded or actuated plug 600, according to one or more embodiments described. FIG. 9 depicts an illustrative, partial section view of the expanded plug 600 depicted in FIG. 8, according to one or more embodiments described.

After actuation or installation of the plug 600, the setting tool can be released from the plug 600, or the insert 100 that is screwed onto the plug 600 by continuing to apply the opposing, axial forces on the mandrel 610 via the adapter rod and the outer cylinder of the setting tool. The opposing, axial forces applied by the outer cylinder and the adapter rod (not shown) result in a compressive load on the mandrel 610, which is borne as internal stress once the plug 600 is actuated and secured within the casing or wellbore 800. The force or stress is focused on the shear groove 130, which will eventually shear, break, or otherwise deform at a predetermined amount, releasing the adapter rod from the plug 600. The predetermined axial force sufficient to deform the shear groove 130 to release the setting tool is less than an axial force sufficient to break the plug 600 otherwise.

Once actuated and released from the setting tool, the plug 600 is left in the wellbore to serve its purpose, as depicted in FIGS. 8 and 9. The solid impediment 211, ball stop 411, and/or one or more of the balls, 409, 701, 702 can be fabricated from one or more decomposable materials. Suitable decomposable materials will decompose, degrade, degenerate, or otherwise fall apart at certain wellbore conditions or environments, such as predetermined temperature, pressure, pH, and/or a combination thereof. As such, fluid flow communication through the plug 600 can be prevented for a predetermined period of time, e.g., until and/or if the decomposable material(s) degrade sufficiently allowing fluid flow therethrough. The predetermined period of time can be sufficient to pressure test one or more hydrocarbon-bearing zones within the wellbore. In one or more embodiments, the predetermined period of time can be sufficient to workover the associated well. The predetermined period of time can range from minutes to days. For example, the degradable rate of the material can range from about 5 minutes, 40 minutes, or 4 hours to about 12 hours, 24 hours or 48 hours. Extended periods of time are also contemplated.

The pressures at which the solid impediment 211, the ball stop 411, and/or one or more of the balls 409, 701, 702 decompose can range from about 100 psig to about 15,000 psig. For example, the pressure can range from a low of about 100 psig, 1,000 psig, or 5,000 psig to a high about 7,500 psig, 10,000 psig, or about 15,000 psig. The temperatures at which the impediment 211, ball stop 411 and/or the ball(s) 409, 701, 702 decompose can range from about 100° F. to about 750° F. For example, the temperature required can range from a low of about 100° F., 150° F., or 200° F. to a high of about 350° F., 500° F., or 750° F.

The decomposable material can be soluble in any material, such as water, polar solvents, non-polar solvents, acids, bases, mixtures thereof, or any combination thereof. The solvents can be time-dependent solvents. A time-dependent solvent can be selected based on its rate of degradation. For example, suitable solvents can include one or more solvents capable of degrading the soluble components in about 30 minutes, 1 hour, or 4 hours, to about 12 hours, 24 hours, or 48 hours. Extended periods of time are also contemplated.

The pHs at which the solid impediment 211, ball stop 411, and/or one or more of the balls 409, 701, 702 decompose can range from about 1 to about 14. For example, the pH can range from a low of about 1, 3, or 5 to a high about 9, 11, or about 14.

To remove the plug 600 from the wellbore, the plug 600 can be drilled-out, milled or otherwise compromised. As it is common to have two or more plugs 600 located in a single wellbore to isolate multiple zones therein, during removal of one or more plugs 600 from the wellbore some remaining portion of the first, upper plug can release from the wall of the wellbore at some point during the drill-out. Thus, when the remaining portion of the first, upper plug 600 falls and engages an upper end of the second, lower plug 600, the anti-rotation features 670 of the remaining portions of the plugs 600, will engage and prevent, or at least substantially reduce, relative rotation therebetween.

Figure 11:
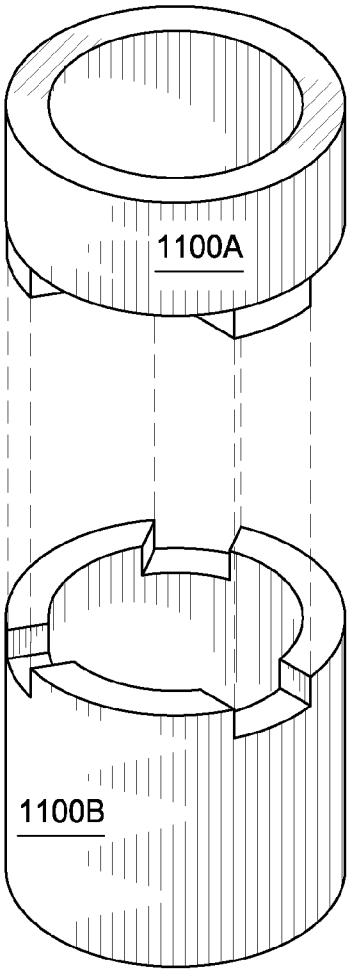
FIG. 11 depicts illustrative, dog clutch anti-rotation features allowing a first plug and a second plug to interact and/or engage in series according to one or more embodiments described.
Figure 10:
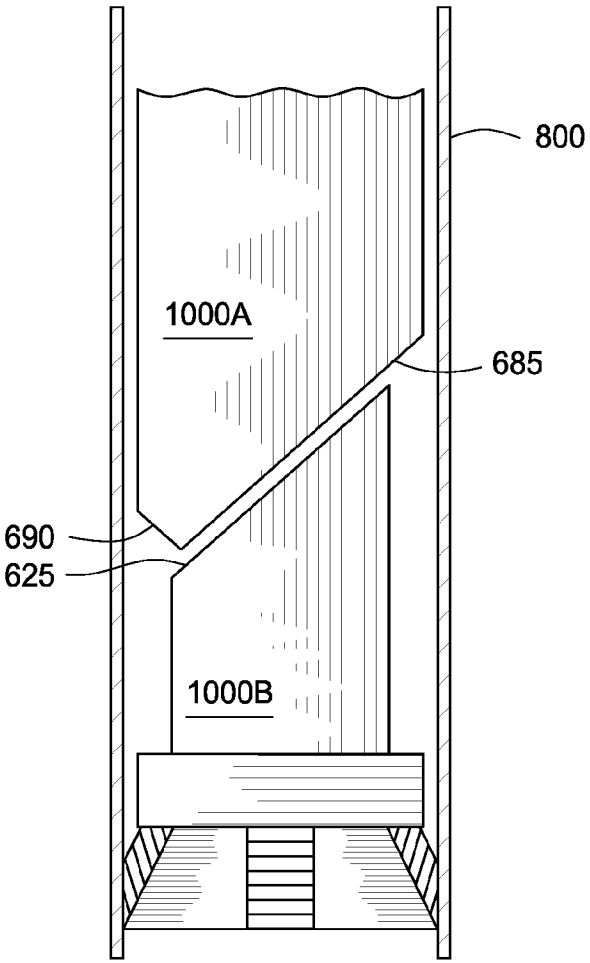
FIG. 10 depicts an illustrative, complementary set of angled surfaces that function as anti-rotation features to interact and/or engage between a first plug and a second plug in series, according to one or more embodiments described.
Figure 13:
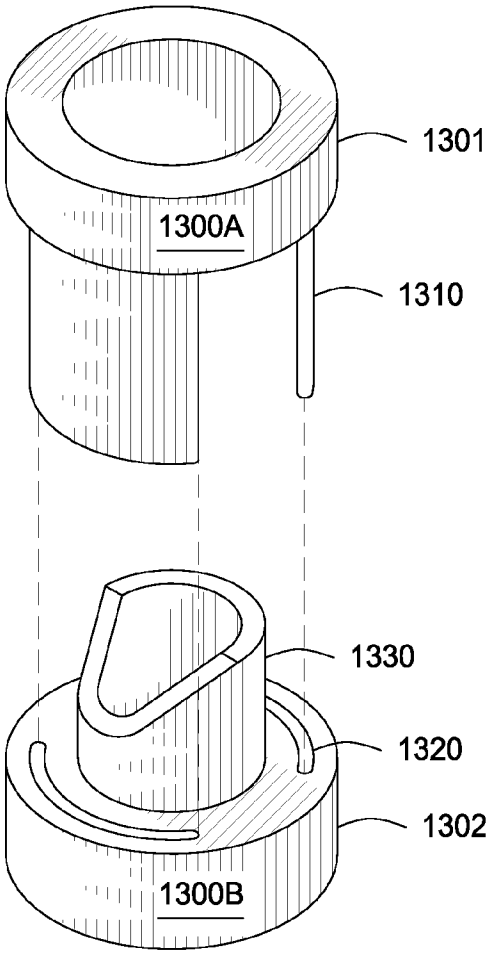
FIG. 13 depicts another illustrative, complementary set of flats and slots that serve as anti-rotation features to interact and/or engage between a first plug and a second plug in series, according to one or more embodiments described.
Figure 12:
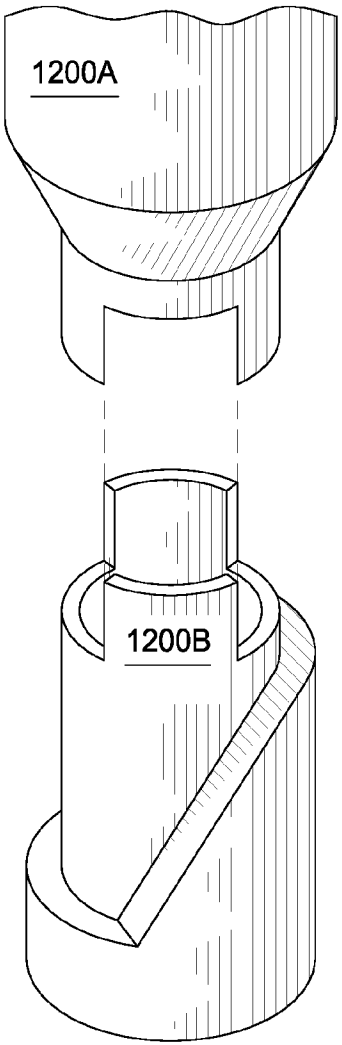
FIG. 12 depicts an illustrative, complementary set of flats and slots that serve as anti-rotation features to interact and/or engage between a first plug and a second plug in series, according to one or more embodiments described.

FIGS. 10-13 depict schematic views of illustrative anti-rotation features that can be used with the plugs 600 to prevent or reduce rotation during drill-out. These features are not intended to be exhaustive, but merely illustrative, as there are many other configurations that are equally effective to accomplish the same results. Each end of the plug 600 can be the same or different. For example, FIG. 10 depicts angled surfaces or half-mule anti-rotation features; FIG. 11 depicts dog clutch type anti-rotation features; and FIGS. 12 and 13 depict two types of flats and slot anti-rotation features.

Referring to FIG. 10, a lower end of the upper plug 1000A and an upper end of a lower plug 1000B are shown within the casing 800 where the angled surfaces 685, 690 interact with, interface with, interconnect, interlock, link with, join, jam with or within, wedge between, or otherwise communicate with a complementary angled surface 625 and/or at least a surface of the wellbore or casing 800. The interaction between the lower end of the upper plug 1000A and the upper end of the lower plug 1000B and/or the casing 800 can counteract a torque placed on the lower end of the upper plug 1000A, and prevent or greatly reduce rotation therebetween. For example, the lower end of the upper plug 1000A can be prevented from rotating within the wellbore or casing 800 by the interaction with upper end of the lower plug 1000B, which is held securely within the casing 800.

Referring to FIG. 11, dog clutch surfaces of the upper plug 1100A can interact with, interface with, interconnect, interlock, link with, join, jam with or within, wedge between, or otherwise communicate with a complementary dog clutch surface of the lower plug 1100B and/or at least a surface of the wellbore or casing 800. The interaction between the lower end of the upper plug 1100A and the upper end of the lower plug 1100B and/or the casing 800 can counteract a torque placed on the lower end of the upper plug 1100A, and prevent or greatly reduce rotation therebetween. For example, the lower end of the upper plug 1100A can be prevented from rotating within the wellbore or casing 800 by the interaction with upper end of the lower plug 1100B, which is held securely within the casing 800.

Referring to FIG. 12, the flats and slot surfaces of the upper plug 1200A can interact with, interface with, interconnect, interlock, link with, join, jam with or within, wedge between, or otherwise communicate with complementary flats and slot surfaces of the lower plug 1200B and/or at least a surface of the wellbore or casing 800. The interaction between the lower end of the upper plug 1200A and the upper end of the lower plug 1200B and/or the casing 800 can counteract a torque placed on the lower end of the upper plug 1200A, and prevent or greatly reduce rotation therebetween. For example, the lower end of the upper plug 1200A can be prevented from rotating within the wellbore or casing 800 by the interaction with upper end of the lower plug 1200B, which is held securely within the casing 800. The protruding perpendicular surfaces of the lower end of the upper plug 1200A can mate in only one resulting configuration with the complementary perpendicular voids of the upper end of the lower plug 1200B. When the lower end of the upper plug 1200A and the upper end of the lower plug 1200B are mated, any further rotational force applied to the lower end of the upper plug 1200A will be resisted by the engagement of the lower plug 1200B with the wellbore or casing 800, translated through the mated surfaces of the anti-rotation feature 670, allowing the lower end of the upper plug 1200A to be more easily drilled-out of the wellbore.

One alternative configuration of flats and slot surfaces is depicted in FIG. 13. The protruding cylindrical or semi-cylindrical surfaces 1310 perpendicular to the base 1301 of the lower end of the upper plug 1300A mate in only one resulting configuration with the complementary aperture(s) 1320 in the complementary base 1302 of the upper end of the lower plug 1300B. Protruding surfaces 1310 can have any geometry perpendicular to the base 1301, as long as the complementary aperture(s) 1320 match the geometry of the protruding surfaces 1301 so that the surfaces 1301 can be threaded into the aperture(s) 1320 with sufficient material remaining in the complementary base 1302 to resist rotational force that can be applied to the lower end of the upper plug 1300A, and thus translated to the complementary base 1302 by means of the protruding surfaces 1301 being inserted into the aperture(s) 1320 of the complementary base 1302. The anti-rotation feature 670 may have one or more protrusions or apertures 1330, as depicted in FIG. 13, to guide, interact with, interface with, interconnect, interlock, link with, join, jam with or within, wedge between, or otherwise communicate or transmit force between the lower end of the upper plug 1300A and the upper end of the lower plug 1300B. The protrusion or aperture 1330 can be of any geometry practical to further the purpose of transmitting force through the anti-rotation feature 670.

The orientation of the components of the anti-rotation features 670 depicted in all figures is arbitrary. Because plugs 600 can be installed in horizontal, vertical, and deviated wellbores, either end of the plug 600 can have any anti-rotation feature 670 geometry, wherein a single plug 600 can have one end of the first geometry and one end of a second geometry. For example, the anti-rotation feature 670 depicted in FIG. 10 can include an alternative embodiment where the lower end of the upper plug 1000A is manufactured with geometry resembling 1000B and vice versa. Each end of each plug 600 can be or include two ends of differently-shaped anti-rotation features, such as an upper end may include a half-mule anti-rotation feature 670, and the lower end of the same plug 600 may include a dog clutch type anti-rotation feature 670. Further, two plugs 600 in series may each comprise only one type of anti-rotation feature 670 each, however the interface between the two plugs 600 may result in two different anti-rotation feature geometries that can interface with, interconnect, interlock, link with, join, jam with or within, wedge between, or otherwise communicate or transmit force between the lower end of the upper plug 600 with the first geometry and the upper end of the lower plug 600 with the second geometry.

Any of the aforementioned components of the plug 600, including the mandrel, rings, cones, elements, shoe, anti-rotation features, etc., can be formed or made from any one or more non-metallic materials or one or more metallic materials (such as aluminum, steel, stainless steel, brass, copper, nickel, cast iron, galvanized or non-galvanized metals, etc.). Suitable non-metallic materials include, but are not limited to, fiberglass, wood, composite materials (such as ceramics, wood/polymer blends, cloth/polymer blends, etc.), and plastics (such as polyethylene, polypropylene, polystyrene, polyurethane, polyethylethylketone (PEEK), polytetrafluoroethylene (PTFE), polyamide resins (such as nylon 6 (N6), nylon 66 (N66)), polyester resins (such as polybutylene terephthalate (PBT), polyethylene terephthalate (PET), polyethylene isophthalate (PEI), PET/PEI copolymer) polynitrile resins (such as polyacrylonitrile (PAN), polymethacrylonitrile, acrylonitrile-styrene copolymers (AS), methacrylonitrile-styrene copolymers, methacrylonitrile-styrene-butadiene copolymers; and acrylonitrile-butadiene-styrene (ABS)), polymethacrylate resins (such as polymethyl methacrylate and polyethylacrylate), cellulose resins (such as cellulose acetate and cellulose acetate butyrate); polyimide resins (such as aromatic polyimides), polycarbonates (PC), elastomers (such as ethylene-propylene rubber (EPR), ethylene propylene-diene monomer rubber (EPDM), styrenic block copolymers (SBC), polyisobutylene (PIB), butyl rubber, neoprene rubber, halobutyl rubber and the like)), as well as mixtures, blends, and copolymers of any and all of the foregoing materials.

However, as many components as possible are made from one or more non-metallic materials, and preferably made from one or more composite materials. Desirable composite materials can include polymeric composite materials that are wound and/or reinforced by one or more fibers such as glass, carbon, or aramid, for example. The individual fibers are typically layered parallel to each other, and wound layer upon layer. Each individual layer can be wound at an angle of from about 20 degrees to about 160 degrees with respect to a common longitudinal axis, to provide additional strength and stiffness to the composite material in high temperature and/or pressure downhole conditions. The particular winding phase can depend, at least in part, on the required strength and/or rigidity of the overall composite material.

The polymeric component of the polymeric composite can be an epoxy blend. However, the polymer component of the polymeric composite can also be or include polyurethanes and/or phenolics, for example. In one aspect, the polymeric composite can be a blend of two or more epoxy resins. For example, the polymeric composite can be a blend of a first epoxy resin of bisphenol A and epichlorohydrin and a second cycoaliphatic epoxy resin. Preferably, the cycloaphatic epoxy resin is ARALDITE® liquid epoxy resin, commercially available from Ciga-Geigy Corporation of Brewster, N.Y. A 50:50 blend by weight of the two resins has been found to provide the suitable stability and strength for use in high temperature and/or pressure applications. The 50:50 epoxy blend can also provide suitable resistance in both high and low pH environments.

The fibers can be wet wound, however, a prepreg roving can also be used to form a matrix. The fibers can also be wound with and/or around, spun with and/or around, molded with and/or around, or hand laid with and/or around a metal material or materials to create an epoxy impregnated metal or a metal impregnated epoxy. For example, a composite of a metal with an epoxy.

A post cure process can be used to achieve greater strength of the material. For example, the post cure process can be a two stage cure consisting of a gel period and a cross-linking period using an anhydride hardener, as is commonly know in the art. Heat can added during the curing process to provide the appropriate reaction energy which drives the cross-linking of the matrix to completion. The composite may also be exposed to ultraviolet light or a high-intensity electron beam to provide the reaction energy to cure the composite material.

Certain embodiments and features have been described using a set of numerical upper limits and a set of numerical lower limits It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

The terms "up" and "down"; "upward" and "downward"; "upper" and "lower"; "upwardly" and "downwardly"; "upstream" and "downstream"; "above" and "below"; and other like terms as used herein refer to relative positions to one another and are not intended to denote a particular spatial orientation since the tool and methods of using same can be equally effective in either horizontal or vertical wellbore uses.

While the foregoing is directed to embodiments of the present invention, other and further embodiments of the invention can be devised without departing from the basic scope thereof, and the scope thereof is determined by the claims that follow.

What is claimed is:

1. A configurable insert for a plug, comprising:
- a body having a bore formed therethrough;
- at least one shear groove disposed on the body;
- at least one shoulder disposed within the bore, the shoulder formed by a transition between a larger inner diameter and a smaller inner diameter of the bore;
- one or more threads disposed on an inner surface of the body between the at least one shear groove and the at least one shoulder;
- an impediment comprising a ball and a ball stop, wherein the ball stop is threadably engaged with the one or more threads disposed on the inner surface of the body, and the ball is contained within the bore between the ball stop and the shoulder; and
- one or more threads disposed on an outer surface of the body for connecting the body to the plug.

2. The configurable insert of claim 1, wherein the body separates at the shear groove when exposed to a predetermined force, and wherein the predetermined force is an axial force, a radial force, or a combination thereof.

3. The configurable insert of claim 1, wherein the bore comprises two shoulders, each shoulder capable of receiving different sized balls.

4. The configurable insert of claim 1, wherein the ball is degradable at a predetermined temperature, pressure, pH, or a combination thereof.

5. The configurable insert of claim 1, wherein the at least one shear groove is an area of reduced wall thickness in the body that is adapted to break at a predetermined force.

6. The configurable insert of claim 1, wherein the ball is adapted to block fluid flow in at least one direction through the bore.

7. The configurable insert of claim 1, further comprising a sloped surface formed on an end of the body, the sloped surface capable of receiving a second ball.

8. The configurable insert of claim 7, wherein the second ball is degradable at a predetermined temperature, pressure, pH, or a combination thereof, and adapted to seat on the sloped surface formed on the end of the body.

9. The configurable insert of claim 1, wherein the body comprises brass, cast iron, or a combination thereof.

10. A configurable insert for a plug, comprising:
- a brass body having a bore formed therethrough;
- one or more threads disposed on an outer surface of the body for connecting to the plug;
- one or more threads disposed on an inner surface of the body for connecting to a setting tool;
- at least one shear groove disposed on the body, wherein the body separates at the shear groove allowing the body to release from the setting tool when exposed to a predetermined force;
- one or more threads disposed on the inner surface of the body below the at least one shear groove;
- at least one shoulder disposed within the bore and below the at least one shear groove, the shoulder having a sloped surface connecting a larger inner diameter of the bore to a smaller inner diameter of the bore; and
- at least one impediment disposed within the bore and below the at least one shear groove.

11. The configurable insert of claim 10, wherein the impediment is a solid component threadably engaged with the one or more threads disposed on the inner surface of the body below the at least one shear groove, and wherein the solid component is adapted to prevent fluid flow in both axial directions through the bore.

12. The configurable insert of claim 10, wherein the impediment is a ball adapted to seat on the sloped surface of the shoulder.

13. The configurable insert of claim 10, wherein the impediment comprises a ball and a ball stop, the ball stop adapted to couple with the one or more threads disposed on the inner surface of the body below the at least one shear groove, such that the ball is contained within the bore between the ball stop and the shoulder.

14. The configurable insert of claim 10, wherein the impediment comprises two balls and a ball stop, wherein the ball stop is adapted to couple with the one or more threads disposed on the inner surface of the body below the at least one shear groove, such that one ball is contained between the ball stop and the shoulder, and the other ball is degradable at a predetermined temperature, pressure, pH, or a combination thereof, and wherein the degradable ball is adapted to seat on a sloped surface formed on an end of the body.

15. A plug, comprising:
- a mandrel formed from one or more composite materials;
- at least one malleable element disposed about the mandrel;
- at least one slip disposed about the mandrel;

at least one conical member disposed about the mandrel; and a configurable insert disposed within the mandrel, the configurable insert comprising:

a body having a bore formed therethrough;

at least one shoulder disposed within the bore, the shoulder formed by a transition between a larger inner diameter of the bore and a smaller inner diameter of the bore, wherein the shoulder is adapted to receive one or more impediments disposed within the bore;

one or more threads disposed on an outer surface of the body for connecting the body to the mandrel;

at least one shear groove disposed on the body, wherein the body separates at the shear groove when exposed to a predetermined force; and one or more threads disposed on an inner surface of the body below the at least one shear groove.

16. The plug of claim 15, wherein the impediment is a solid component threadably engaged with the one or more threads disposed on the inner surface of the body, and the solid component is adapted to prevent fluid flow in both axial directions through the bore.

17. The plug of claim 15, wherein the impediment is a ball.

18. The configurable insert of claim 15, wherein the impediment comprises a ball and a ball stop, the ball stop adapted to couple with the one or more threads disposed on the inner surface of the body such that the ball is contained within the bore between the ball stop and the shoulder.

19. The configurable insert of claim 15, wherein the impediment comprises two balls and a ball stop adapted to couple with the one or more threads disposed on the inner surface of the body such that one ball is contained between the ball stop and the shoulder, and the other ball is degradable at a predetermined temperature, pressure, pH, or a combination thereof, and the degradable ball is adapted to seat on a sloped surface formed on an end of the body.

20. A plug, comprising:

a mandrel formed from one or more composite materials;

at least one malleable element disposed about the mandrel;

at least one slip disposed about the mandrel;

at least one conical member disposed about the mandrel; and a configurable insert disposed within the mandrel, the configurable insert comprising:

a body having a bore formed therethrough;

at least one shoulder disposed within the bore, the shoulder formed by a transition between a larger inner diameter of the bore and a smaller inner diameter of the bore;

a ball disposed within the bore and adjacent the shoulder;

one or more threads disposed on an outer surface of the body for connecting the body to the mandrel;

at least one shear groove disposed on the body; and one or more threads disposed on an inner surface of the body below the at least one shear groove.

21. The plug of claim 20, wherein the body separates at the shear groove when exposed to a predetermined force, and wherein the predetermined force is an axial force, a radial force, or a combination thereof.

22. The plug of claim 20, wherein the configurable insert comprises two shoulders disposed within the bore.

23. The plug of claim 20, wherein the at least one shear groove is an area of reduced wall thickness in the body that is adapted to break at a predetermined force.

24. The plug of claim 20, further comprising a sloped surface formed on an end of the body, the sloped surface capable of receiving a second ball.

25. The plug of claim 24, wherein the second ball is degradable at a predetermined temperature, pressure, pH, or a combination thereof.

26. The plug of claim 20, further comprising a ball stop coupled with the one or more threads disposed on the inner surface of the body such that the ball is contained within the bore between the ball stop and the shoulder.

27. The plug of claim 20, wherein the body comprises brass, cast iron, or a combination thereof.

28. The plug of claim 20, wherein the at least one shoulder is disposed below the at least one shear groove.

* * * * *

UNITED STATES PATENT AND TRADEMARK OFFICE

CERTIFICATE OF CORRECTION

PATENT NO. : 8,307,892 B2
APPLICATION NO. : 13/357570
DATED : November 13, 2012
INVENTOR(S) : Warren L. Frazier It is certified that error appears in the above-identified patent and that said Letters Patent is hereby corrected as shown below:

Column 9, line 8: "from the lower" should read --on the upper--.

Signed and Sealed this
Twenty-ninth Day of January, 2013

David J. Kappos

David J. Kappos
*Director of the United States Patent and Trademark Office*